US008827765B2

(12) United States Patent
Zhang

(10) Patent No.: US 8,827,765 B2
(45) Date of Patent: Sep. 9, 2014

(54) PADDED BREAST CUP FOR A BRASSIERE

(75) Inventor: Wen Bo Zhang, Kwai Chung (HK)

(73) Assignee: Regina Miracle International (Group) Limited, Hong Kong (HK)

( * ) Notice: Subject to any disclaimer, the term of this patent is extended or adjusted under 35 U.S.C. 154(b) by 185 days.

(21) Appl. No.: 12/858,583

(22) Filed: Aug. 18, 2010

(65) Prior Publication Data

US 2012/0045966 A1 Feb. 23, 2012

(51) Int. Cl.
*A41C 3/00* (2006.01)
*A41C 3/14* (2006.01)

(52) U.S. Cl.
CPC ..... *A41C 3/144* (2013.01); *A41C 3/146* (2013.01)
USPC ..... 450/54; 450/39; 450/57

(58) Field of Classification Search
USPC ..... 450/37–39, 54–58; 2/267, 268
See application file for complete search history.

(56) References Cited

U.S. PATENT DOCUMENTS

| | | | | |
|---|---|---|---|---|
| 2,697,228 | A * | 12/1954 | Orr | 450/57 |
| 2,834,352 | A * | 5/1958 | Ullian | 450/57 |
| 3,384,091 | A * | 5/1968 | Block | 450/54 |
| 3,814,107 | A * | 6/1974 | Greenblatt et al. | 450/56 |
| 4,992,074 | A * | 2/1991 | Diaz | 450/81 |
| 6,042,608 | A * | 3/2000 | Ishikawa et al. | 623/7 |
| 6,174,217 | B1 * | 1/2001 | Judson | 450/1 |
| 6,443,806 | B1 * | 9/2002 | Fang | 450/57 |
| 6,824,444 | B2 * | 11/2004 | Huang | 450/57 |
| 7,163,433 | B2 * | 1/2007 | Chou | 450/81 |
| 7,252,574 | B2 * | 8/2007 | Chen | 450/38 |
| 7,458,877 | B2 * | 12/2008 | Yu | 450/39 |
| 8,216,021 | B1 * | 7/2012 | MacKinnon | 450/54 |
| 2008/0096464 | A1 | 4/2008 | Falla | 450/38 |
| 2008/0153388 | A1 * | 6/2008 | Liu | 450/39 |
| 2010/0273395 | A1 | 10/2010 | Castellano | 450/39 |

FOREIGN PATENT DOCUMENTS

| | | | |
|---|---|---|---|
| CN | 1241380 | A | 1/2000 |
| CN | 2465493 | Y | 12/2001 |
| CN | 2756021 | Y | 2/2006 |
| CN | 200983848 | Y | 12/2007 |
| CN | 201097628 | Y | 8/2008 |
| CN | 101267751 | A | 9/2008 |
| CN | 201312558 | Y | 9/2009 |
| CN | 201349529 | Y | 11/2009 |
| CN | 102125313 | A | 7/2011 |

OTHER PUBLICATIONS

Chinese Office Action and Search Report mailed Apr. 9, 2014 in counterpart Chinese Patent Application No. 201110447577.3, along with an English translation of the Search Report.

* cited by examiner

*Primary Examiner* — Gloria Hale
(74) *Attorney, Agent, or Firm* — Ostrolenk Faber LLP

(57) ABSTRACT

There is provided a breast cup assembly for a bra. An outer panel has an outer fabric layer attached to a first foam layer. An inner panel has an inner fabric layer attached to a second foam layer. A pad is located between the inner panel and the outer panel. The inner panel has a surface area the majority of which is overlaid with the pad, and the outer panel and the inner panel are attached to each other about a periphery of each panel to retain the pad in its location.

20 Claims, 3 Drawing Sheets

PADDED BREAST CUP FOR A BRASSIERE

FIELD OF THE INVENTION

The present invention relates generally to brassieres and in particular to a breast cup assembly, a method of manufacturing a breast cup and a brassiere incorporating two breast cups.

BACKGROUND TO THE INVENTION

A conventional brassiere (hereinafter referred to as a bra) includes a pair of breast cups, a connecting portion connecting the inner edges of the breast cups, a back wing that extends from outer edges of the breast cups around the back of the wearer, and shoulder straps extending from upper edges of the breast cups over the shoulder of the wearer and connected to the back wing. The function of the bra is to provide support for the wearer's bust in a manner that is comfortable to the wearer. It is becoming increasingly desirable for the bra to enhance the appearance of the wearer's bust while maintaining a natural look and feel.

The appearance of the wearer's bust can be enhanced by including pads, often referred to as "cookies", in the breast cup to create the illusion of a larger breast size. The "cookies" can be formed from a foam material, generally polyurethane, or alternatively the pad is a bladder containing a fluid. In either form the pad is typically positioned within the lower portion of the breast cup to provide support to the breast and enhance the shape of the bra.

While the use of pads has enhanced the size of the wearer's breasts, certain disadvantages have resulted from their use. These disadvantages relate to the way the bra feels to touch and the appearance the bra makes under the wearer's clothes. This has resulted in a less than natural look and feel.

In light of the foregoing, there is an ongoing need for bras that enhance the appearance of the wearers bust while maintaining a natural look or feel.

SUMMARY OF THE INVENTION

According to one aspect of this invention there is provided a breast cup assembly for use in a bra, the assembly including, an outer panel having an outer fabric layer attached to a first foam layer, an inner panel having an inner fabric layer attached to a second foam layer, a pad located between the inner panel and the outer panel, the inner panel having a surface area the majority of which is overlaid with the pad, the outer panel and the inner panel being attached to each other about a periphery of each panel to retain the pad in its location.

The pad may be a thermoplastic rubber such as a styrene block copolymer, or alternatively the pad may be a semi-liquid silicon such as a functional polydimethylsiloxane with an acetoxysilane cross linker.

It is preferred that the pad includes at least one channel extending between the inner panel and the outer panel.

It is preferred that the first and second foam layers are thermoplastic polyurethane. It is further preferred that the first and second foam layer is attached to the inner and outer fabrics respectively by lamination.

It is preferred that the pad has a melting point higher than the foam layers of the inner panel or the outer panel.

It is preferred that the inner panel and the outer panel are concave.

It is preferred that the pad overlies the surface area of the inner panel by more than 55%.

It is preferred that the foam of the inner panel and the outer panel is of substantially uniform thickness adjacent the pad while the thickness of the pad is relatively non-uniform when viewed in cross section from an upper edge of the breast cup to a lower edge of the breast cup. It is further preferred that the pad is relatively thick in a middle region of the breast cup and relatively thin in an edge region of the breast cup.

It is preferred that the pad has a lower edge that is aligned to extend substantially parallel with a convex lower edge of the cup, and the pad has an upper edge that is generally non-uniformly divergent from a convex upper edge of the cup. It is further preferred that the upper edge of the pad includes a concave portion. It is still further preferred that the concave portion is to one side of a centre of the upper edge.

According to another aspect of this invention there is provided a bra including two breast cups as hereinbefore described with a connecting portion connecting one edge of each breast cup and a back wing connected to another edge of each cup remote from said one edge, each back wing having a free end which are releasably attached to one another when attaching the bra to a wearer's body.

According to a still further aspect of this invention there is provided a method of manufacturing a breast cup for inclusion in a bra, the method including the steps of:

i) providing an outer panel including an outer fabric and a first foam layer,
ii) molding the outer panel to a concave form,
iii) providing an inner panel including an inner fabric and a second foam layer,
iv) moulding the inner panel to a concave form,
v) locating a pad between the inner panel and the outer panel so that the pad is adjacent the first foam layer and the second foam layer and overlies a majority of the surface area of the inner panel,
vi) attaching the inner panel to the outer panel about a periphery of each panel.

It is preferred that the step of attaching the inner panel and outer panel includes heating the inner panel and the outer panel to a bonding temperature, and the pad is selected from a thermoplastic rubber or a semi-liquid silicon having a melting point above the bonding temperature.

It is preferred that the step of molding the inner panel and outer panel to a concave form includes heating the inner panel and outer panel to a molding temperature which is lower that the melting point of the pad.

BRIEF DESCRIPTION OF THE DRAWINGS

It will be convenient to hereinafter describe the invention in greater detail by reference to the accompanying drawings which show two preferred embodiments of the invention, and to facilitate understanding of the method according to this invention. The particularity of the figures and the related description is not intended to supersede the generality of the broad definition of the invention as given in the attached claims.

DETAILED DESCRIPTION OF THE EMBODIMENTS

Figure 1:
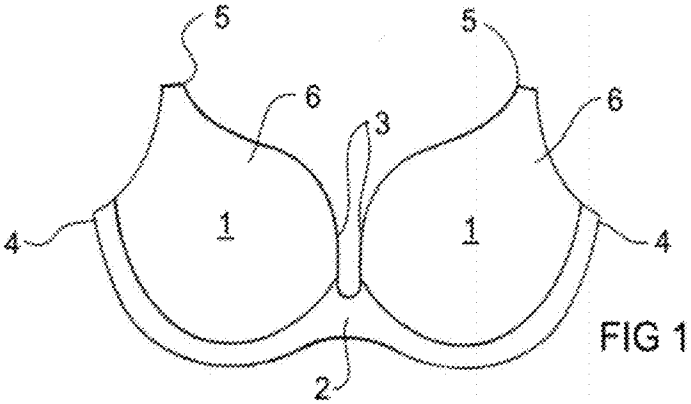
FIG. 1 is a front view of part of a bra according to a preferred embodiment of the invention.

FIG. 1 illustrates two breast cups 1 with a connecting portion 2 connecting adjacent edges 3 of each breast cup 1. When forming a bra (not shown) with the breast cups 1 a back wing (not shown) is connected to a distal side edge 4 of each cup 1 remote from the connecting portion. A shoulder strap (not shown) may also be included extending from an upper edge 5 of each breast cup 1 over the shoulder of the wearer and connected to the back wing. Each breast cup 1 includes an outer fabric layer 6, and an inner fabric layer 7 which can be appreciated from FIG. 2. The inner fabric layer 7 is intended to contact the skin of the wearer.

Figure 3A:
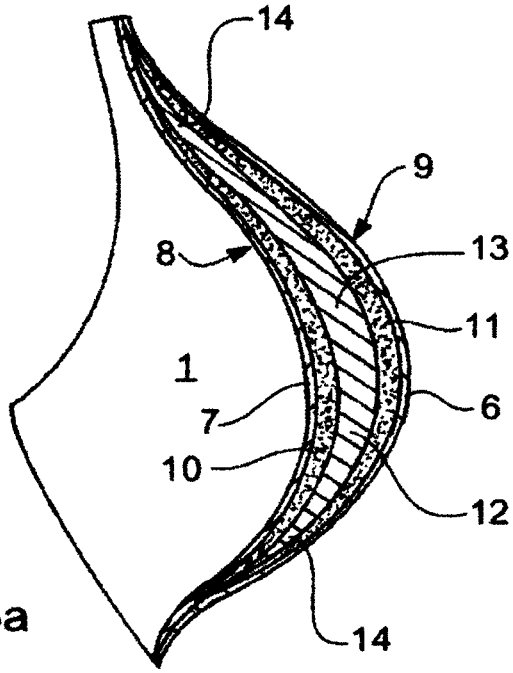
FIG. 3*a* is one preferred embodiment of the cross section through AA of FIG. 2.

The internal structure of one preferred form of a breast cup 1 is illustrated in FIG. 3*a* which shows the inner fabric 7 and outer fabric 6 forming part of an inner panel 8 and outer panel 9 respectively. The inner panel 8 includes a first foam layer 10 laminated to the inner fabric 7, and the outer panel 9 includes a second foam layer 11, to distinguish it from the first foam layer 10, laminated to the outer fabric 6. The inner and outer fabric layers 6, 7 and the first and second foam layers 10, 11 may be fabrics and foams as disclosed in U.S. Pat. No. U.S. 7,179,150B2, the contents of which are taken to be incorporated herein by this cross-reference. This patent also discloses how the fabrics 6, 7 may be laminated to the foam layers 10, 11. It is preferable however that the first and second foam layers 10, 11 are a thermoplastic polyurethane.

Each breast cup 1 includes a pad 12 located between the inner panel 8 and the outer panel 9. Whilst the pad 12 may be formed from any suitable material, it is preferred that it be formed from a thermoplastic rubber such as a styrene block copolymer or a semi-liquid silicone such as a functional polydimethylsiloxane with an acetoxysilane cross linker. Clearly other materials may be suitable. However, it is generally preferred that the melting point of the pad 12 material be higher than that of the first or second foam layers 10, 11 for reasons that will be explained with reference to the method of manufacture of the breast cup.

The thickness of the first foam layer 10 and second foam layer 11 is preferably substantially uniform in the area adjacent to the pad 12. The first foam layer 10 and second foam layer 11 is compressed at the edges of the cup 1 as can be appreciated from FIG. 3*a*, as a result of the method of attaching the inner panel 8 to the outer panel 9. This method of attaching will be described later in the specification. In contrast the thickness of the pad 12 is preferably non-uniform. More specifically the pad 12 is preferably thicker in a middle region 13 of the cup 1 and relatively thin at edge regions 14 of the cup 1. This smooth transition from the edge reigns 14 to the middle regions 13 is preferred so as to provide the external surface of the breast cup 1 with a smooth appearance.

Figure 2:
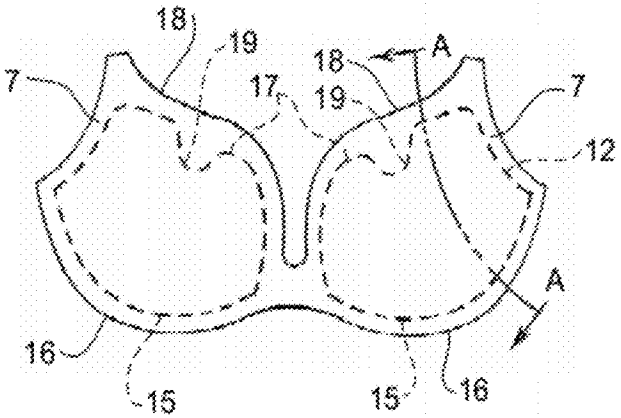
FIG. 2 is a rear view of the bra from FIG. 1.

It can be appreciated from FIG. 2 that the pad 12 is located over the majority of the surface area of the inner panel 8. The degree to which the pad 12 extends over the surface area of the inner panel 8 may vary. However, it is preferred that it occupy at least 55% of the surface area of the inner panel and most preferably more than 85%. Overlaying of the pad 12 over a majority of the panel 8 reduces the likelihood that the bra will look or feel lumpy when in use, which can be the case when a pad 12 of the prior art is positioned within a lower portion of the breast cup 1 only.

FIG. 2 also illustrates the pad 12 having a convex lower edge 15 which is positioned relative to a lower edge 16 of the inner panel 8 so that both lower edges 15, 16 extend substantially parallel to each other. In contrast an upper edge 17 of the pad 12 is generally divergent from a convex upper edge 18 of the inner panel 8. In particular FIG. 2 illustrates the upper edge 17 of the pad 12 defining a concave portion 19 slightly off centre. This concave portion 19 enables the pad 12 to conform to the molded shape of the breast cup 1 without forming wrinkles when in use.

Figure 3B:
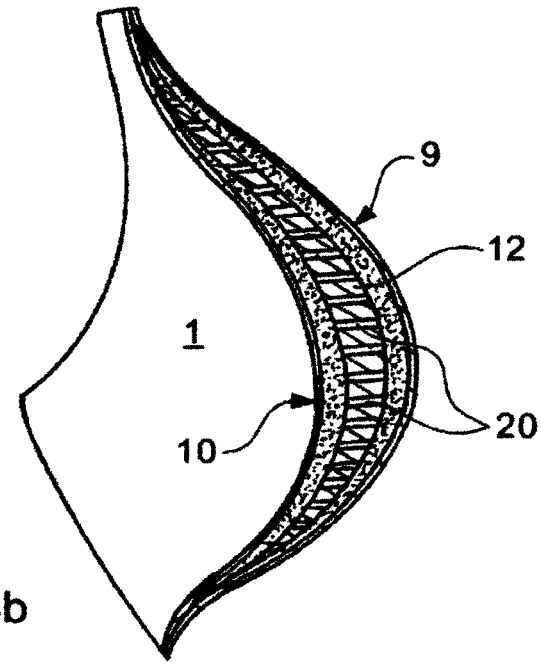
FIG. 3*b* is another preferred embodiment of the cross section through AA of FIG. 2.

FIG. 3*b* illustrates another preferred embodiment of the breast cup 1 and in particular a variation to the pad 12. The pad 12 illustrated includes a number of horizontal channels 20 which increase the permeability of the pad 12 allowing for air flow between the inner panel 8 and the outer panel 9.

The inner panel 8 is attached to outer panel 9 around the periphery of each breast cup 1. The panels 8, 9 may be connected by any suitable manner such as an adhesive or ultrasonic welding.

Figure 4:
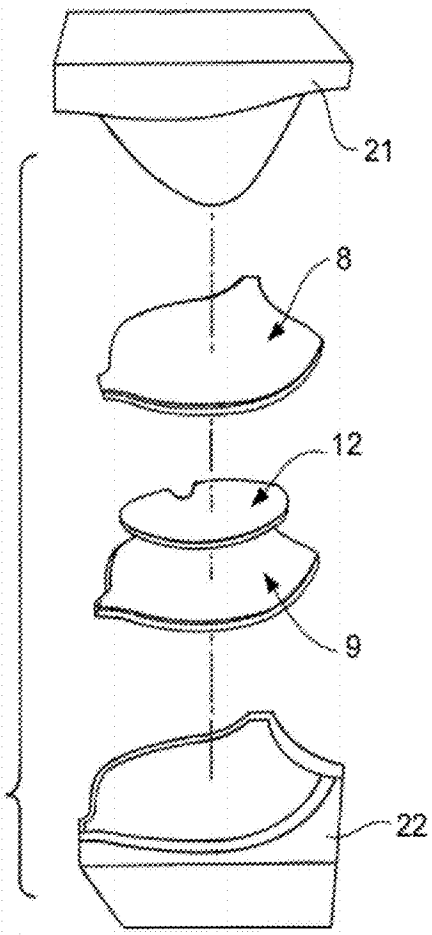
FIG. 4 is an exploded view of a preferred embodiment of a step in the method of manufacturing.
Figure 5:
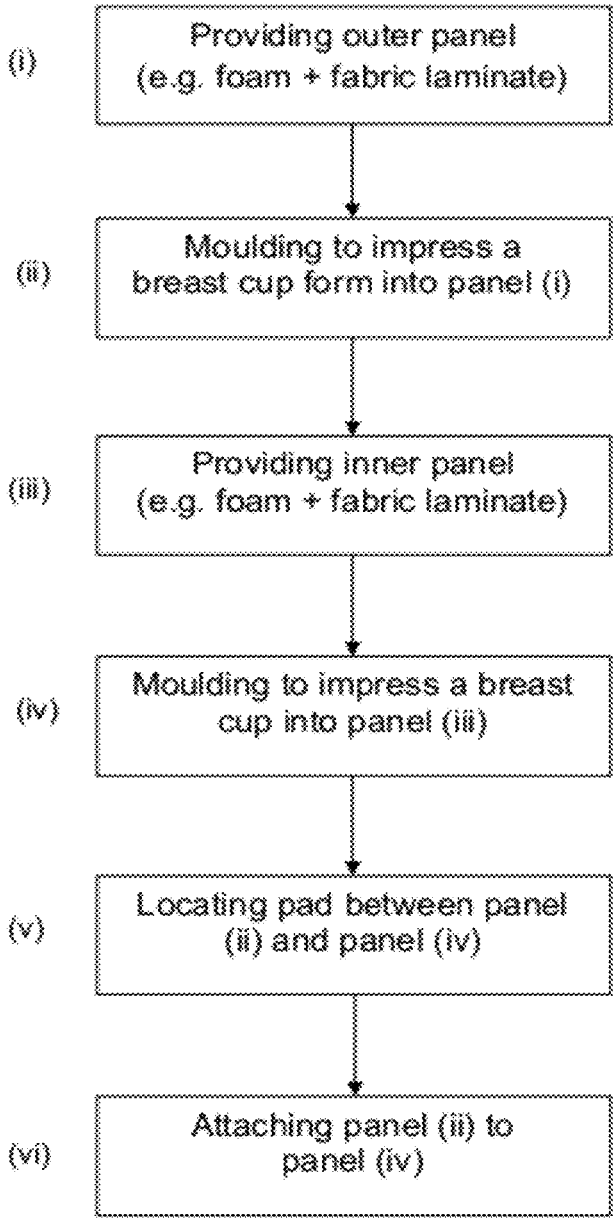
FIG. 5 is a flow chart illustrating the steps of manufacture of a breast cup according to another embodiment of the invention.

With reference to FIGS. 4 and 5 the first step (i) in the method of manufacturing a breast cup 1 is to provide an outer panel 9 including a layer of what is to be the outer fabric 6 and a second foam layer 11. Then in step (ii) the outer panel 9 is molded by the way of molds, for example a convex upper mold 21 and a concave lower mold 22 as shown in FIG. 4. Preferably heat is applied during this molding process to develop a concave form in the outer panel 9. The degree to which the panel 9 is heated may vary depending upon the materials used. However, where the second foam layer 11 is formed from a polyurethane foam it is preferred to heat the panel 9 to about 190° C. to 200° C. Steps (i) and (ii) are repeated as steps (iii) and (iv) for the inner panel 8 so as to produce an inner panel 8 and outer panel 9 both of concave form. The next step (v) is to locate a pad 12 between the inner panel 8 and outer panel 9 so that the pad 12 is adjacent the first foam layer 10 and the second foam layer 11 and is sized to overlie a majority of the surface area of the inner panel 8. The next step (vi) includes attaching the inner panel 8 to the outer panel 9 around the periphery of each panel 8, 9. This attaching step (vi) may include applying an adhesive to the periphery of the inner and outer panel 8, 9 and the application of further heat. The degree to which heat is applied in this step will vary depending upon the materials used for the pad 12 and whilst it is preferred that the breast cup 1 be heated to 190° C. to 200° C. during this attaching process this could result in the pad 12 melting if some types of materials are used. Where the materials used for the pad 12 have a melting point below 190° C., it is preferred that the location step v) be made after the attachment step vi). In this situation the upper edge 18 and side edges 3, 4 of the inner panel 8 and outer panel 9 are attached leaving an opening along the lower edge 16 between the inner and outer panels 8, 9 to allow the location of the pad 12 therethrough. Once the pad 12 is located the opening can be closed by attaching the lower edge 16 of the inner panel 8 to the lower edge 16 of the outer panel 9 using a lower heat of for example 100° C.

It ought to be appreciated from the foregoing that overlaying the majority of the inner panel 8 with the pad 12, as opposed to locating the pad at a lower region reduces the likelihood that the breast cup 1 will appear or feel lumpy. The selection of a thermoplastic rubber or semi-liquid silicon for the pad 12 further enhances the smooth appearance and feel of the breast cup.

While the invention has been described in conjunction with a limited number of embodiments, it will be appreciated that many alternative modifications and variations in light of the foregoing description are possible. Accordingly, the present invention is intended to embrace all such alternative modifications and variations as may fall within the spirit and scope of the invention as disclosed in the attached claims.

What is claimed is:

1. A breast cup assembly for use in a bra, the assembly including:

an outer panel having an outer fabric layer attached to a first foam layer, an inner panel having an inner fabric layer attached to a second foam layer, and a pad located between the inner panel and the outer panel, the inner panel having a surface area the majority of which is overlaid with the pad, the outer panel and the inner panel being attached to each other about a periphery of each panel to retain the pad in its location, wherein the pad has an upper edge that is generally non-uniformly divergent from a convex upper edge of the inner panel, the upper edge of the pad including a concave portion, a divergence of the concave portion from the convex upper edge of the inner panel being greater than a divergence of portions of the upper edge of the pad, which are outside of the concave portion, from the convex upper edge of the inner panel.

2. A breast cup according to claim 1, wherein the pad is a thermoplastic rubber.

3. A breast cup according to claim 1, wherein the pad is a styrene block copolymer.

4. A breast cup according to claim 1, wherein the pad includes at least one channel extending between the inner panel and the outer panel.

5. A breast cup according to claim 1, wherein the pad is semi-liquid silicon.

6. A breast cup according to claim 5, wherein the semi-liquid silicon is a functional polydimethylsiloxane with an acetoxysilane cross linker.

7. A breast cup according to claim 1, wherein the first and second foam layer are thermoplastic polyurethane.

8. A breast cup according to claim 1, wherein the first and second foam layers are attached to the outer and inner fabrics respectively by lamination.

9. A breast cup according to claim 1, wherein the pad has a melting point higher than the foam layers of the inner panel or the outer panel.

10. A breast cup according to claim 1, wherein the inner panel and the outer panel are concave.

11. A breast cup according to claim 1, wherein the pad overlies the surface area of the inner panel by more than 55%.

12. A breast cup according to claim 1, wherein the foam layers of the inner panel and the outer panel are of substantially uniform thickness adjacent the pad, while the thickness of the pad is relatively non-uniform, when viewed in cross section, from an upper edge of the cup to a lower edge of the cup.

13. A breast cup according to claim 12, wherein the pad is relatively thick in a middle region of the cup and relatively thin in an edge region of the cup.

14. A breast cup according to claim 1, wherein the pad has a lower edge that is aligned to extend substantially parallel with a convex lower edge of the inner panel.

15. A breast cup according to claim 1, wherein the concave portion is to one side of a center of the upper edge.

16. A bra including two breast cups as claimed in claim 1 with a connecting portion connecting a first edge of each breast cup and a back wing connected to a second edge of each cup remote from said first edge, each back wing having a free end, the free ends being releasably attached to one another when attaching the bra to a wearer's body.

17. A method of manufacturing a single breast cup for inclusion in a bra, the method including the steps of:

i) providing an outer panel including an outer fabric and a first foam layer, ii) molding the outer panel so that the outer panel assumes a single concave form in a form of the single breast cup, iii) providing an inner panel including an inner fabric and a second foam layer, iv) molding the inner panel so that the inner panel assumes a single concave form in a form of the single breast cup, v) locating a pad between the inner panel and the outer panel so that the pad is adjacent the first foam layer and the second foam layer and overlies a majority of the surface area of the inner panel, vi) attaching the inner panel to the outer panel about a periphery of each panel, wherein the pad has an upper edge that is generally non-uniformly divergent from a convex upper edge of the inner panel, the upper edge of the pad including a concave portion, a divergence of the concave portion from the convex upper edge of the inner panel being greater than a divergence of portions of the upper edge of the pad, which are outside of the concave portion, from the convex upper edge of the inner panel.

18. A method of manufacturing a single breast cup according to claim 17, wherein the step of attaching the inner panel and outer panel includes heating the inner panel and the outer panel to a bonding temperature, and the pad is selected from a thermoplastic rubber or semi-liquid silicon having a melting point above the bonding temperature.

19. A method of manufacturing a single breast cup according to claim 17, wherein the steps of molding the inner panel and the outer panel so that the inner panel and the outer panel each assume a single concave form include heating the inner panel and outer panel to a molding temperature which is lower that the melting point of the pad.

20. A breast cup assembly for use in a bra, the assembly including: an outer panel having a single concave form and an outer fabric layer attached to a first foam layer, an inner panel having an inner fabric layer attached to a second foam layer, and a pad located between the inner panel and the outer panel, the inner panel having a surface area the majority of which is overlaid with the pad, the outer panel and the inner panel being attached to each other about a periphery of each panel to retain the pad in its location, wherein the pad has an upper edge that is generally non-uniformly divergent from a convex upper edge of the inner panel, the upper edge of the pad including a concave portion, a divergence of the concave portion from the convex upper edge of the inner panel being greater than a divergence of portions of the upper edge of the pad, which are outside of the concave portion, from the convex upper edge of the inner panel.

* * * * *